US011278778B1

(12) United States Patent
Dean, Jr.

(10) Patent No.: US 11,278,778 B1
(45) Date of Patent: Mar. 22, 2022

(54) CROSSED GOLF TEE

(71) Applicant: Elliot James Dean, Jr., Lafayette, LA (US)

(72) Inventor: Elliot James Dean, Jr., Lafayette, LA (US)

( * ) Notice: Subject to any disclaimer, the term of this patent is extended or adjusted under 35 U.S.C. 154(b) by 0 days.

(21) Appl. No.: 17/104,156

(22) Filed: Nov. 25, 2020

Related U.S. Application Data

(60) Provisional application No. 62/940,320, filed on Nov. 26, 2019.

(51) Int. Cl.
*A63B 57/10* (2015.01)

(52) U.S. Cl.
CPC ..... *A63B 57/10* (2015.10)

(58) Field of Classification Search
CPC ..... A63B 57/10; A63B 57/15; A63B 57/19
See application file for complete search history.

(56) References Cited

U.S. PATENT DOCUMENTS

D33,792 S * 12/1900 Adkins ..... D8/47
851,351 A * 4/1907 Hanley ..... B25B 13/48 7/138
1,112,056 A * 9/1914 De Bow ..... B25C 3/008 81/44
D54,894 S * 4/1920 Carlson ..... D8/47
1,596,110 A 8/1926 Lynch
1,761,532 A 6/1930 Morris
2,074,519 A * 3/1937 Shephard ..... A63B 57/10 473/402
2,121,113 A 6/1938 Barr
2,128,049 A 8/1938 Karkoska
2,165,479 A 7/1939 Hallberg
2,451,311 A * 10/1948 Andreasen, Sr. ..... A63B 57/10 473/257
D152,218 S * 12/1948 Reitman ..... D21/718
D158,622 S 5/1950 Sherwin
2,555,222 A * 5/1951 Coleman ..... A63B 57/15 473/390
D201,890 S 8/1965 Dreyfus
3,347,551 A 10/1967 Dreyfus
3,448,984 A 6/1969 Dreyfus
3,675,929 A 7/1972 Guarino, Sr.
3,883,144 A 5/1975 Lazow
D244,398 S 5/1977 Graham
4,128,245 A 12/1978 Vlach
4,181,311 A 1/1980 Lawlor
4,328,969 A * 5/1982 Wright ..... A63B 57/10 473/390
4,669,725 A 6/1987 Taylor
D293,261 S 12/1987 Sadowski
D307,929 S 5/1990 Parkerson
5,240,254 A 8/1993 Adlam
D339,840 S 9/1993 Coconate
5,437,448 A 8/1995 Balson
5,492,330 A 2/1996 Eldridge, Jr. et al.
D385,939 S 11/1997 Suk
5,738,598 A 4/1998 Wu
5,755,629 A 5/1998 Blomgren
D399,896 S 10/1998 Plain
D411,276 S 6/1999 Rosenfeld
(Continued)

*Primary Examiner* — Steven B Wong
(74) *Attorney, Agent, or Firm* — Law Office of Greg Mier, LLC; Greg Mier

(57) ABSTRACT

A crossed golf tee that assists with the alignment of a golf shot when using the golf tee.

4 Claims, 1 Drawing Sheet

(56) References Cited

U.S. PATENT DOCUMENTS

| | | | | | |
|---|---|---|---|---|---|
| D428,954 | S | | 8/2000 | Tate | |
| D431,849 | S | | 10/2000 | MacDonald | |
| D434,817 | S | * | 12/2000 | Cole, Jr. | D21/718 |
| D439,944 | S | | 4/2001 | Graham | |
| D490,133 | S | | 5/2004 | Hadala | |
| D491,990 | S | | 6/2004 | Lu | |
| 6,769,999 | B1 | | 8/2004 | Chase | |
| 7,052,416 | B2 | | 5/2006 | Chang | |
| D526,371 | S | | 8/2006 | Bayfield | |
| 7,338,394 | B2 | | 3/2008 | Harris | |
| D602,102 | S | | 10/2009 | Tapia | |
| D613,797 | S | | 4/2010 | Krapf et al. | |
| 7,713,147 | B1 | | 5/2010 | Tapia | |
| 7,846,034 | B1 | | 12/2010 | Lightfoot | |
| 8,974,322 | B1 | | 3/2015 | Jones | |
| D746,390 | S | | 12/2015 | Keller | |
| 9,474,951 | B2 | | 10/2016 | Chuang | |
| D776,773 | S | | 1/2017 | Elsherbini | |
| 10,279,232 | B2 | | 5/2019 | Pope | |
| D865,883 | S | | 11/2019 | Hayes | |
| 10,569,148 | B2 | | 2/2020 | Gauvin | |
| 2005/0009645 | A1 | | 1/2005 | Isabell | |
| 2006/0287136 | A1 | * | 12/2006 | Oleksyk | A63B 57/203<br>473/387 |
| 2013/0012332 | A1 | * | 1/2013 | Leyva | A63B 57/10<br>473/266 |

* cited by examiner

CROSSED GOLF TEE

CROSS REFERENCE TO RELATED APPLICATIONS

The present application claims priority from provisional patent application No. 62/940,320, filed on Nov. 26, 2019.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC

Not applicable.

FIELD OF THE INVENTION

The subject invention relates generally to equipment used in the game of golf. More particularly, the subject invention relates to a golf tee that assists with the alignment of a golf shot when using the golf tee.

BACKGROUND OF THE INVENTION

The prior art is filled with different types of golf tees that are used to stabilize a golf ball above the ground on the first golf shot of a hole, such as, for example, U.S. Pat. No. 8,439,771 to Fleming, and the other references cited therein. The prior art is also filled with different types of golf tees that can be used to help align a golf shot when using the golf tee, such as, for example, U.S. Pat. No. 4,181,311 issued to Lawlor, U.S. Design Pat. No. 399,896 issued to Plain, U.S. Design Pat. No. 865,883 issued to Hayes, and U.S. Pat. No. 4,669,725 issued to Taylor, and the other references cited therein. None of the prior art discloses the present invention, where the two intersecting parts of the invention can be interchangeably used as either the part that aligns the golf shot or the part that stabilizes the golf ball, depending on the type of golf shot that is being made with the invention.

BRIEF DESCRIPTION OF THE ATTACHED DRAWING

The accompanying drawings are provided for the purpose of illustration only and are not intended as a definition of the limits of the present invention. The drawings illustrate a preferred embodiment of the present invention.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

The present invention has two primary purposes. The first primary purpose is to stabilize a golf ball above the ground when making a golf shot. The second primary purpose is to help align a golf shot when the shot is being made while using the present invention.

The present invention is preferably made of plastic or wood but can be made of any other material suitable for a golf tee.

The present invention is a crossed golf tee 10. The crossed golf tee 10 preferably has two primary components, including a first elongated stem 11 and a second elongated stem 12.

Figure 2:
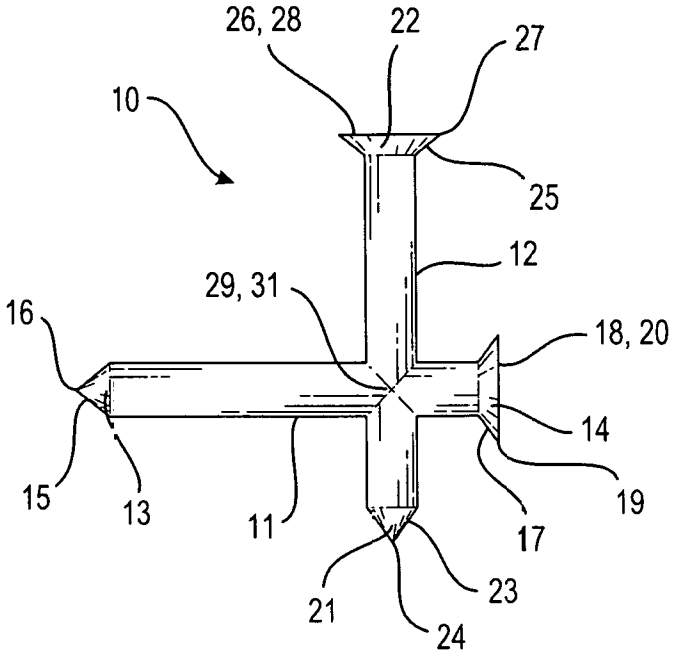
FIG. 2 is another side view of the preferred embodiment of the crossed golf tee of the present invention.
Figure 1:
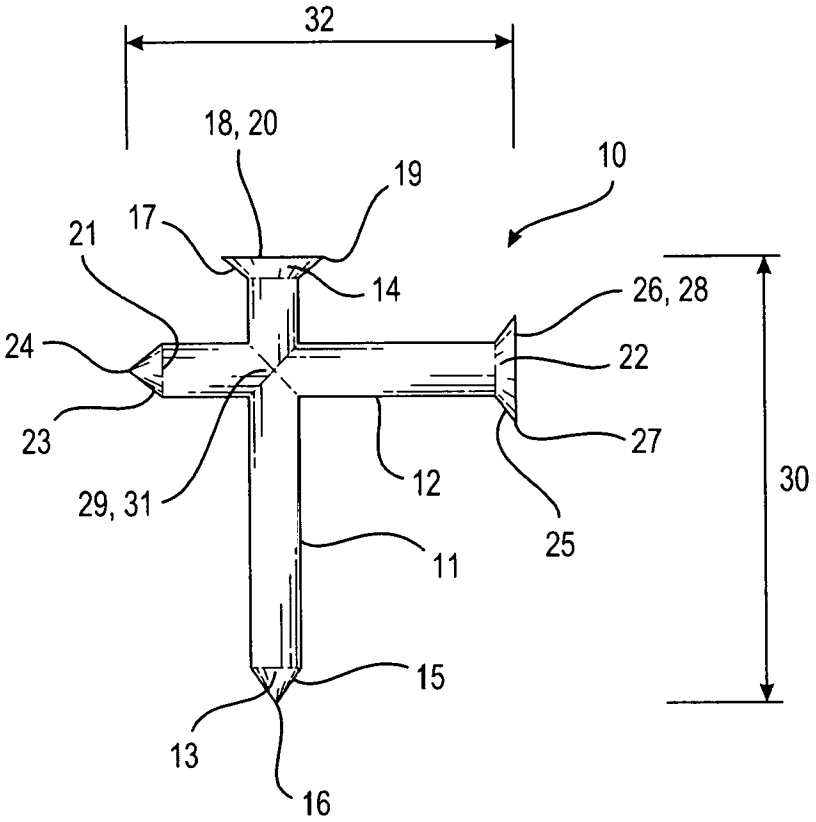
FIG. 1 is a side view of the preferred embodiment of the crossed golf tee of the present invention.

As shown in FIGS. 1 and 2, the first elongated stem 11 preferably has a first end 13 and a second end 14. The first end 13 preferably has an inward taper 15 that terminates in a point 16 so that the first end 13 can be forcibly inserted into the ground. The second end 14 preferably has a has an outward taper 17 that terminates in a head 18 which is defined by a circular, outer edge 19 and a hemispherical or concave cup 20 to support a golf ball (not shown) when first end 13 is inserted into the ground. The curvature of the cup 20 preferably corresponds to the curvature of a standard golf ball and should have a sufficient diameter to adequately support the golf ball.

Still referring to FIGS. 1 and 2, the second elongated stem 12 preferably has a first end 21 and a second end 22. The first end 21 preferably has an inward taper 23 that terminates in a point 24 so that the first end 21 can be forcibly inserted into the ground. The second end 22 preferably has a has an outward taper 25 that terminates in a head 26 which is defined by a circular, outer edge 27 and a hemispherical or concave cup 28 to support a golf ball (not shown) when first end 21 is inserted into the ground. The curvature of the cup 28 preferably corresponds to the curvature of a standard golf ball and should have a sufficient diameter to adequately support the golf ball.

In the preferred embodiment of the crossed golf tee 10, the first elongated stem 11 perpendicularly intersects the second elongated stem 12 at a predetermined location 29 along the length 30 of first elongated stem 11 and at a predetermined location 31 along the length 32 of the second elongated stem 12, as shown in FIGS. 1 and 2.

In one embodiment of the crossed golf tee 10, the predetermined location 28 along the first elongated stem 11 is one-third of the length 29 of the first elongated stem 11 measured from the head 18 of the first elongated stem 11, and the predetermined location 30 along the second elongated stem 12 is one-third of the length 31 of the second elongated stem 12 measured from the point 24 of the second elongated stem 12.

In another embodiment of the crossed golf tee 10, the predetermined location 29 along the first elongated stem 11 is one-half of the length 30 of the first elongated stem 11 measured from the head 18 of the first elongated stem 11, and the predetermined location 31 along the second elongated stem 12 is one-half of the length 32 of the second elongated stem 12 measured from the point 24 of the second elongated stem 12.

The length 30 of first elongated stem 11 is preferably between two and five inches. The length 32 of the second elongated stem 12 is preferably between two and five inches.

In use, the crossed golf tee 10 can be inserted into the ground using either the first elongated stem 11 or the second elongated stem 12. Determining which elongated stem to insert into the ground will depend on the type of golf shot being made. Referring to FIG. 1, if the golfer desires the golf ball to be positioned relatively closer to the ground, then the golfer should insert into the ground the first end 13 of the first elongated stem 11 until the second elongated stem 12 acts as a stop and limits the extent of penetration of the first elongated stem 11 into the ground. The position of the second elongated stem 12 ensures that the level or height of the golf ball supported on the head 18 of the first elongated stem 11 is consistent. Once the first elongated stem 11 is inserted into the ground as discussed above, then the horizontal second elongated stem 12 can be pointed in the direction of the target area for the golf shot, thereby assisting with the alignment of the golf shot.

Still referring to FIG. 1, if the golfer desires the golf ball to be positioned relatively farther from the ground, then the golfer should insert into the ground the first end 21 of the second elongated stem 12 until the first elongated stem 11 acts as a stop and limits the extent of penetration of the second elongated stem 12 into the ground. The position of the first elongated stem 11 ensures that the level or height of the golf ball supported on the head 26 of the second elongated stem 12 is consistent. Once the second elongated stem 12 is inserted into the ground as discussed above, then the horizontal first elongated stem 11 can be pointed in the direction of the target area for the golf shot, thereby assisting with the alignment of the golf shot.

It is understood that one embodiment of the present invention has been disclosed by way of example and that other modifications and alterations may occur to those skilled in the art without departing from the scope and spirit of the present invention.

What is claimed is:

1. A crossed golf tee comprising:

(a) a first elongated stem having a length, a first end, and a second end opposite said first end;

(b) a second elongated stem having a length, a first end, and a second end opposite said first end, where said second elongated stem perpendicularly intersects said first elongated stem at a predetermined location along said length of said first elongated stem and at a predetermined location along said length of said second elongated stem, where said first end of said first elongated stem has an inward taper that terminates in a point, where said second end of said first elongated stem has an outward taper that terminates in a head which is defined by a circular, outer edge and a hemispherical or concave cup to support a golf ball, where said first end of said second elongated stem has an inward taper that terminates in a point, where said second end of said second elongated stem has an outward taper that terminates in a head which is defined by a circular, outer edge and a hemispherical or concave cup to support a golf ball, where said second elongated stem perpendicularly intersects said first elongated stem at a location on said first elongated stem that is one-third of said length of said first elongated stem from said head of said first elongated stem, and where said first elongated stem perpendicularly intersects said second elongated stem at a location on said second elongated stem that is one-third of said length of said second elongated stem from said point of said second elongated stem.

2. The crossed golf tee of claim 1, where said length of said first elongated stem from said head to said point of said first elongated stem is two and one-fourth inches, and where said length of said second elongated stem from said head to said point of second elongated stem is two and one-fourth inches.

3. The crossed golf tee of claim 1, where said length of said first elongated stem from said head to said point of said first elongated stem is four inches, and where said length of said second elongated stem from said head to said point of second elongated stem is four inches.

4. The crossed golf tee of claim 1, where said length of said first elongated stem from said head to said point of said first elongated stem is between two inches and five inches, and where said length of said second elongated stem from said head to said point of second elongated stem is between two inches and five inches.

* * * * *